US005669160A

United States Patent [19]

Pozzebon

[11] Patent Number: 5,669,160

[45] Date of Patent: Sep. 23, 1997

[54] INNERBOOT PARTICULARLY FOR SKATES

[75] Inventor: Adolfo Pozzebon, Sala D'Istrana, Italy

[73] Assignee: Noridica S.p.A., Trevignano, Italy

[21] Appl. No.: 655,202

[22] Filed: May 28, 1996

Related U.S. Application Data

[63] Continuation of Ser. No. 206,380, Mar. 7, 1994, abandoned.

[30] Foreign Application Priority Data

Mar. 25, 1993 [IT] Italy ..... TV93U0013

[51] Int. Cl.[6] ..... A43B 5/04

[52] U.S. Cl. ..... 36/10; 36/50.5; 36/115

[58] Field of Search ..... 36/117.6, 10, 97, 36/99, 105, 110, 112, 115, 138, 55, 50.5; 12/142 P

[56] References Cited

U.S. PATENT DOCUMENTS

| | | | |
|---|---|---|---|
| 231,632 | 8/1880 | Thecker | 36/50.1 |
| 770,535 | 9/1904 | Phillips | 36/50.1 |
| 1,345,407 | 7/1920 | Schneider | 36/50.1 |
| 2,420,239 | 5/1947 | Hack | 36/105 X |
| 2,494,770 | 1/1950 | MacLaughlin | 36/112 X |
| 2,619,744 | 12/1952 | Mattes | 36/105 |
| 2,688,810 | 9/1954 | Baumann | 36/10 |
| 2,795,865 | 6/1957 | Backiel | 36/10 |
| 3,192,651 | 7/1965 | Smith | 36/105 |
| 3,419,974 | 1/1969 | Lange | 36/117.6 |
| 3,426,454 | 2/1969 | Mitchell et al. | 36/10 |
| 3,530,596 | 9/1970 | Kaufmann et al. | 36/99 |
| 3,581,412 | 6/1971 | Dalebout . | |
| 3,613,271 | 10/1971 | Geller | 12/142 P X |
| 3,694,940 | 10/1972 | Stohr | 36/10 |
| 3,762,075 | 10/1973 | Munschy | 36/112 X |
| 3,786,580 | 1/1974 | Dalebout | 12/142 P X |
| 3,810,318 | 5/1974 | Epstein | 36/105 |
| 4,178,703 | 12/1979 | Pols | 36/105 X |
| 4,182,056 | 1/1980 | Dalebout | 12/142 P X |
| 4,599,811 | 7/1986 | Rousseau | 36/97 X |
| 4,689,902 | 9/1987 | Lewis, Jr. | 36/105 X |
| 4,969,277 | 11/1990 | Williams | 36/50.1 X |
| 5,544,433 | 8/1996 | Borsoi et al. | 36/10 |

FOREIGN PATENT DOCUMENTS

| | | | |
|---|---|---|---|
| 0066133 | 12/1982 | European Pat. Off. | 36/119 |
| 321474 | 1/1903 | France . | |
| 7115124 | 9/1971 | Germany . | |
| 2461701 | 11/1976 | Germany | 36/105 |
| 7831331 | 2/1979 | Germany . | |
| 3043425 | 7/1982 | Germany | 36/115 |

*Primary Examiner*—Ted Kavanaugh
*Attorney, Agent, or Firm*—Giodo Modiano; Albert Josif

[57] ABSTRACT

Innerboot particularly usable for skates including a first half-shell and a second separate half-shell that can be mutually coupled. The first and the second half-shells have flaps that partially surround the other half-shell, so as to allow to obtain an innerboot usable both for front-entry shoe and for rear-entry shoe, with an increase in thickness in the areas subjected to a more intense pressure.

17 Claims, 1 Drawing Sheet

INNERBOOT PARTICULARLY FOR SKATES

This is a continuation of application No. 08/206,380, filed on Mar. 7, 1994, now abandoned.

BACKGROUND OF THE INVENTION

The present invention relates to an innerboot particularly usable for skates.

It is currently known to manufacture sports shoes, such as for example roller or ice skates or ski boots, which comprise a shell and one or more quarters articulated thereto.

These components are usually made of rigid material, so that it is necessary to use an innerboot made of soft material to improve the fit of the foot.

Innerboots obtained with conventional methods or by foaming, used particularly in ski boots, can currently be generally divided into complete innerboots for front-entry boots and partial innerboots for rear-entry boots.

More in detail, the complete innerboot has, in its front part, so that it can be put on, a longitudinal opening which is covered by a large tongue fixed at the tip of the innerboot.

This embodiment allows the tongue to move laterally with respect to the tibia and the foot instep and produces uncomfortable bulges of material especially in the region where the tongue overlaps the upper. This innerboot is also uncomfortable in the tibial region and in the metatarsal region.

The partial innerboot is constituted by an innerboot that only surrounds the front part of the foot and of the leg, leaving exposed the ankle and heel regions as well as the rear part of the leg.

The regions left exposed by the innerboot are protected and contained by paddings applied to the rear quarter that constitutes the boot.

In this embodiment, unpleasant bulges of material form in the region where the padding overlaps the innerboot, producing pressure points in the ankle and calf regions.

Furthermore, as can be easily understood, these different innerboots are considerably expensive from the point of view of standardization, since it is necessary to produce different parts to constitute a complete or partial innerboot; various processing steps are furthermore required to stitch the padding at the edges on the quarters of the boot.

As a partial solution to these drawbacks, this same Applicant filed, on 19 May, 1981, an Italian Utility Model application no. 21814 B/81, which discloses an innerboot particularly for ski boots comprising a body which affects the region of the foot and from which a quarter extends. The main feature of this innerboot resides in the fact that a longitudinal notch is present on the quarter and is delimited by a pair of mutually superimposable flaps.

Although this solution is undoubtedly valid, it has the drawback that it can be provided specifically for rear-entry ski boots, and its use is thus limited to this configuration.

Italian Utility Model patent application no. 30614 B/77, filed on 3 Feb. 1977 discloses a soft innerboot particularly for rigid shoes which has the feature of comprising two complementary parts obtained by hot vacuum-forming of a continuous sheet of compact foam. These two parts are already connected along part of the connecting perimeter, and the remaining part of the perimeter is subsequently welded with means for stable connection.

This solution, too, has drawbacks, since it can be used only for shoes such as front-entry ski boots.

SUMMARY OF THE INVENTION

The aim of the present invention is to solve the described technical problems, eliminating the drawbacks of the known art and thus providing an innerboot for sports shoes such as roller or ice skates or ski boots, which can be used regardless of the configuration of the shoe and thus for front-entry, rear-entry and mixed configurations.

Within the scope of the above aim, an important object of the present invention is to provide an innerboot that allows optimum fit of the foot by adapting to its shape.

Another object of the invention is to provide an innerboot that ensures optimum accommodation of the foot especially at the regions subjected to the most intense pressures during sports practice.

Another important object of the invention is to provide an innerboot that is structurally simple, easy and rapid to manufacture, has low manufacturing costs and also facilitates extreme standardization of the components.

This aim, these objects and others which will become apparent hereinafter are achieved by an innerboot particularly for skates, characterized in that it comprises a first half-shell and a second separate half-shell which can be mutually coupled and have flaps partially surrounding said other half-shell.

BRIEF DESCRIPTION OF THE DRAWINGS

Further characteristics and advantages of the innerboot according to the present invention will become apparent from the following detailed description of a particular embodiment thereof, illustrated only by way of non-limitative example in the accompanying drawings, wherein.

DESCRIPTION OF THE PREFERRED EMBODIMENTS

Figure 1:
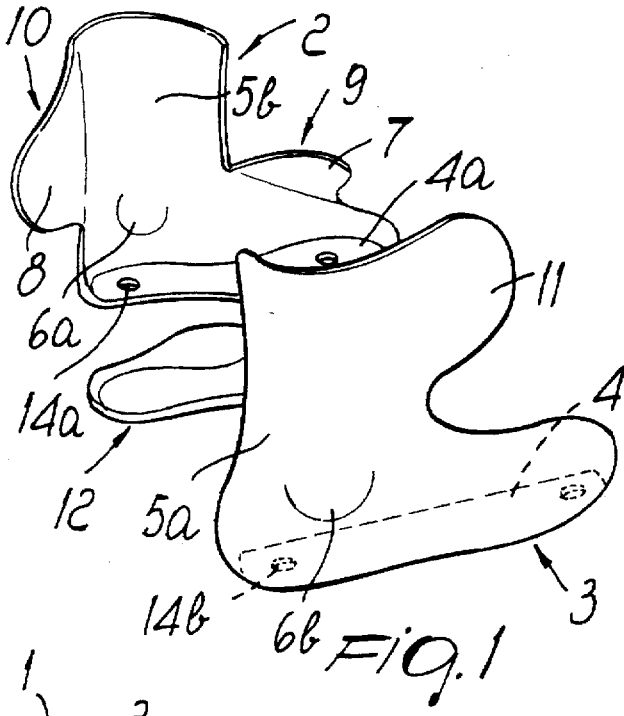
FIG. 1 is an exploded perspective view of the innerboot.
Figure 2:
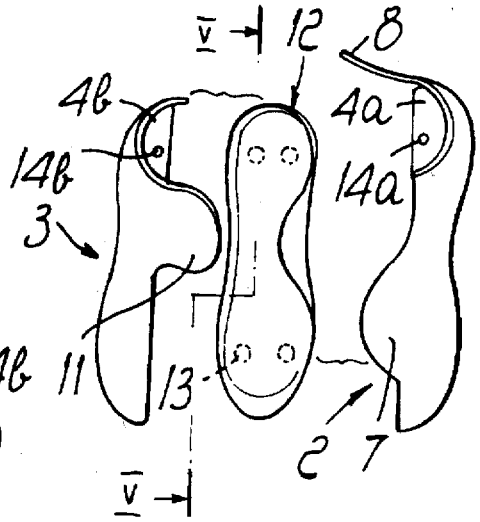
FIG. 2 is an exploded top view of the innerboot.

With reference to the above figures, the reference numeral 1 generally designates the innerboot, which is particularly usable for sports shoes such as for example roller or ice skates or ski boots.

The innerboot is constituted by a first half-shell 2 and by a separate second half-shell 3. Both half-shells are obtained for example by thermoformation. Each of the two half-shells has a half-insole, designated by the reference numerals *4a* and *4b*, from which a half-body *5a* and *5b* extends and surrounds the lateral region of the foot, around half of the metatarsal and instep regions, around the entire malleolar regions *6a* and *6b*, and around part of the tibia.

Both the first 2 and the second 3 half-shells have one or more flaps protruding from the half-bodies *5a* and *5b*. In this particular embodiment, the first half-shell 2 has a first 7 and a second 8 flaps each protrudingly extending from one lateral region of the innerboot respectively at the metatarsal region 9 and at the rear ankle and/or tibial region 10. The first and second flaps have such dimensions as to partially surround the second half-shell 3 in the closed position of the innerboot, as seen in FIGS. 3, 4, and 6.

Figure 3:
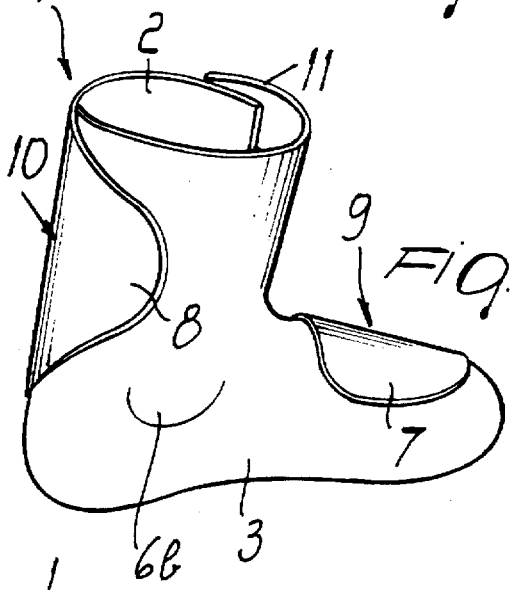
FIG. 3 is a side perspective view of the innerboot in assembled condition.
Figure 4:
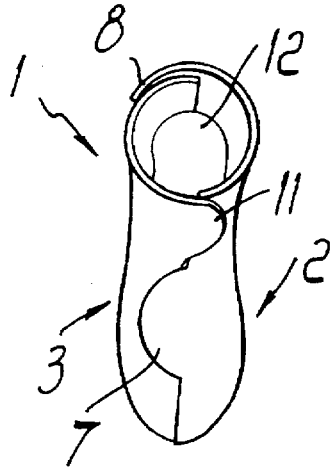
FIG. 4 is a top view of the innerboot.
Figure 5:
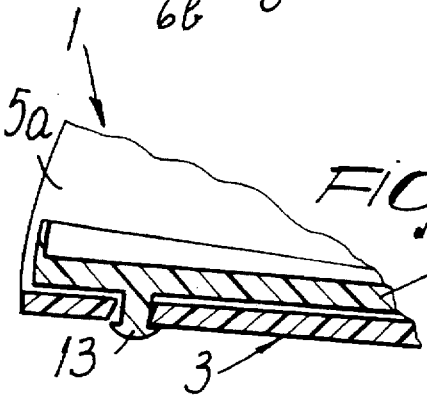
FIG. 5 is a sectional partial view, taken along the plane V—V of FIG. 2.
Figure 6:
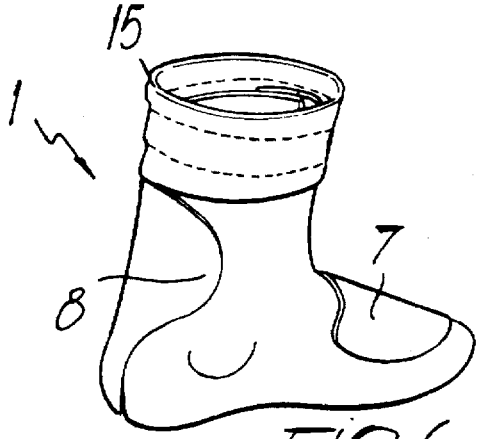
FIG. 6 is a view, similar to FIG. 3, of the innerboot.

The second half-shell has a third flap 11 protrudingly extending from another lateral region of the innerboot at the front region of the user's tibia so as to partially surround the first half-shell 2 in the closed position of the innerboot, as seen in FIGS. 3, 4, and 6.

The first and the second half-shells are connected by means of known systems, such as stitching, welding or glueing.

In order to improve the connection between the first 2 and the second 3 half-shells, or as an alternative to the conventional fastening systems, an adapted sole 12 is provided with means for temporary connection to the half-soles 4*a* and 4*b*. This means is preferably constituted by a plurality of adapted mushroom-shaped lugs 13 the head whereof is inserted, for example in a snap-together manner, at adapted holes 14*a* and 14*b* formed on the half-soles 4*a* and 4*b*.

Use of the invention is in fact as follows: once the first and the second half-shells have been produced separately, they can be mutually associated, by simply placing them side by side or by joining them, as mentioned above, making the first, second and third flaps partially wrap around the other half-shell.

In this manner, or as an alternative to the use of the sole 12, one obtains an innerboot usable for shoes having either front-region or rear-region foot insertion, because the second flap 8 or the third flap 11 can be simply gripped and moved in an open position in order to insert the foot.

As an alternative, the first and second half-shells can be mutually temporarily associated in the closed position of the innerboot by using an adapted band 15 which is preferably elastic or of the tear-open type, which surrounds the upper ends of the half-bodies 5*a* and 5*b* while leaving access, for example, to the first flap 7, the second flap 8 and the third flap 11.

It has thus been observed that the invention has achieved the intended aim and objects, an innerboot for sports shoes having been obtained that allows universal use and can adapt without curling to changes in the volumes of the shoes. Furthermore, the padding is doubled at critical points by virtue of the overlap of the first, second and third flaps on the other half-shell.

Naturally, said half-shells can be mutually coupled by means of different solutions, such as for example the stitching or welding of the half-soles.

Naturally, the number and shape of the flaps as well as the materials and dimensions of the individual components of the innerboot may be the most pertinent according to the specific requirements.

What is claimed is:

1. An innerboot for shorts shoes, said innerboot having an inside and comprising:

a first lateral portion for surrounding at least a user's first lateral region;

a second lateral portion for surrounding at least a user's second lateral region;

a releasably closable front opening extending continuously between said first and second lateral portions at a metatarsal region of the innerboot and at a front tibia region of the innerboot, said front opening extending from a top-most portion of the innerboot to a tip region of the innerboot;

a first flap portion connected to and protrudingly extending from said first lateral portion; and a second flap portion connected to and protrudingly extending from said second lateral portion;

wherein said first flap portion is movably positionable between an open position in which said front opening is open allowing for insertion of a user's foot in the inside of the innerboot and a closed position in which said front opening is closed and in which said first flap portion is arranged to at least partially overlap said second lateral portion with respect to the inside of the innerboot at said metatarsal region of the innerboot, and wherein said second flap portion is movably positionable between said open position and said closed position in which said second flap portion is arranged to at least partially overlap said first lateral portion with respect to the inside of the innerboot at said front tibia region of the innerboot, and wherein said first flap portion is a continuous flap portion extending from a front-most portion of said first flap portion rearwardly to a rear-most portion of said first flap portion, and said second flap portion is a continuous flap portion extending from a bottom-most portion of said second flap portion upwardly to a top-most portion of said flap portion, and wherein in the closed position said rear most portion of said first flap portion is arranged substantially adjacent said bottom-most portion of said second flap portion, and wherein in the closed position said front-most portion, and wherein in the closed position said front-most portion of said first flap portion is arranged to cover said front opening at the tip region of the innerboot, and wherein in the closed position said top-most portion of said second flap portion is arranged to cover said front opening at the top-most portion of the innerboot.

2. The innerboot of claim 1, further comprising a third flap portion which is connected to and protrudingly extends from one of said first and second lateral portions and which is movably positionable between an open position allowing for insertion of a user's foot in the inside of the innerboot and a closed position in which said third flap portion is arranged to overlap the other one of said first and second lateral portions with respect to the inside of the innerboot at a rear ankle region of the innerboot.

3. The innerboot of claim 1, further comprising:

a first half-shell having a first half-insole and a first half-body which includes said first lateral portion;

a second half-shell having a second half-insole and a second half-body which includes said second lateral portion; and connecting means for mutually connecting said first and second half-shells to form the innerboot.

4. The innerboot of claim 3, wherein said connecting means mutually connect said first and second half insoles thereby to form an insole of the innerboot.

5. The innerboot of claim 4, further comprising a sole element arranged over said insole of the innerboot, said connecting means comprising holes provided in said insole and mushroom-shaped lugs protruding downwardly from said sole element and arranged in a snap-together manner in said holes.

6. The innerboot of claim 3, wherein said connecting means comprise stitching means.

7. The innerboot of claim 3, wherein said connecting means comprise welding means.

8. The innerboot of claim 3, wherein said connecting means comprise gluing means.

9. The innerboot of claim 3, wherein the first lateral region is an inner malleolar region and the second lateral region is an outer malleolar region.

10. The innerboot of claim 3, further comprising an elastic band arranged to surround upper ends of said first and second lateral portions.

11. The innerboot of claim 1, wherein said first and second flap portions are the only flap portions extending between said first and second lateral portions for closing said front opening.

12. The innerboot of claim 1, wherein said first flap portion and said second flap portion are devoid of connection elements, whereby said first and second flap portions are adapted for being securely closed in place in the closed position by an outer rigid structure inside which the innerboot is accommodatable.

13. A sports shoe comprising an innerboot positioned inside an outer rigid structure, said innerboot being less rigid than said outer rigid structure, said innerboot having an inside and comprising:

a first lateral portion for surrounding at least a user's first lateral region;

a second lateral portion for surrounding at least a user's second lateral region;

a releasably closable front opening extending continuously between said first and second lateral portions at a metatarsal region of the innerboot and at a front tibia region of the innerboot, said front opening extending from a top-most portion of the innerboot to a tip region of the innerboot;

a first flap portion connected to and protrudingly extending from said first lateral portion; and a second flap portion connected to and protrudingly extending from said second lateral portion;

wherein said first flap portion is movably positionable between an open position in which said front opening is open allowing for insertion of a user's foot in the inside of the innerboot and a closed position in which said front opening is closed and in which said first flap portion is arranged to at least partially overlap said second lateral portion with respect to the inside of the innerboot at said metatarsal region of the innerboot, and wherein said second flap portion is movably positionable between said open position and said closed position in which said second flap portion is arranged to at least partially overlap said first lateral portion with respect to the inside of the innerboot at said front tibia region of the innerboot, and wherein said first flap portion is a continuous flap portion extending from a front-most portion of said first flap portion rearwardly to a rear-most portion of said first flap portion, and said second flap portion is a continuous flap portion extending from a bottom-most portion of said second flap portion upwardly to a top-most portion of said flap portion, and wherein in the closed position said rear-most portion of said first flap portion is arranged substantially adjacent said bottom-most portion of said second flap portion, and wherein in the closed position said front-most portion of said first flap portion is arranged to cover said front opening at the tip region of the innerboot, and wherein in the closed position said top-most portion of said second flap portion is arranged to cover said front opening at the top-most portion of the innerboot.

14. The sport shoe of claim 13, wherein the innerboot further comprises a third flap portion which is connected to and protrudingly extends from one of said first and second lateral portions and which is movably positionable between an open position allowing for insertion of a user's foot in the inside of the innerboot and a closed position in which said third flap portion is arranged to overlap the other one of said first and second lateral portions with respect to the inside of the innerboot at a rear ankle region of the innerboot.

15. The sports shoe of claim 13, wherein the innerboot further comprises:

a first half-shell having a first half insole and a first half-body which includes said first lateral portion;

a second half-shell having a second half-insole and a second half-body which includes said second lateral portion; and connecting means for mutually connecting said first and second half-shells to form the innerboot.

16. The sports shoe of claim 13, wherein said first and second flap portions are the only flap portions extending between said first and second lateral portions for closing said front opening.

17. The sports shoe of claim 13, wherein said first flap portion and said second flap portion are devoid of connection elements, and wherein said first and second flap portions are securely closed in place in the closed position by said outer rigid structure.

* * * * *

UNITED STATES PATENT AND TRADEMARK OFFICE

CERTIFICATE OF CORRECTION

PATENT NO. : 5,669.160

DATED : September 23, 1997

INVENTOR(S) : Adolfo Pozzebon

It is certified that error appears in the above-identified patent and that said Letters Patent is hereby corrected as shown below:

On the cover page, item [73] Assignee should read --Nordica S.p.A.--.

Signed and Sealed this

Tenth Day of February, 1998

Bruce Lehman

*Attest:*

BRUCE LEHMAN

*Attesting Officer*

*Commissioner of Patents and Trademarks*